US008931762B2

(12) United States Patent
Ha et al.

(10) Patent No.: US 8,931,762 B2
(45) Date of Patent: Jan. 13, 2015

(54) AIR CONDITIONER

(75) Inventors: Hyunpil Ha, Changwon-si (KR); Jeongsang Seo, Changwon-si (KR); Jungmin Moon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 496 days.

(21) Appl. No.: 13/208,637

(22) Filed: Aug. 12, 2011

(65) Prior Publication Data

US 2012/0161343 A1 Jun. 28, 2012

(30) Foreign Application Priority Data

| | | |
|---|---|---|
| Dec. 23, 2010 | (KR) | 10-2010-0133742 |
| Dec. 23, 2010 | (KR) | 10-2010-0133743 |
| Dec. 23, 2010 | (KR) | 10-2010-0133744 |
| Jan. 10, 2011 | (KR) | 10-2011-0002317 |

(51) Int. Cl.
*B01F 3/04* (2006.01)
*F24F 6/06* (2006.01)

(52) U.S. Cl.
CPC ..... *F24F 6/06* (2013.01)
USPC ..... 261/83; 261/92; 261/94; 55/471

(58) Field of Classification Search
USPC ..... 261/83, 92, 94; 55/467, 471
See application file for complete search history.

(56) References Cited

FOREIGN PATENT DOCUMENTS

| | | | | |
|---|---|---|---|---|
| CN | 201488168 | U | | 5/2010 |
| JP | 2009-85511 | A | | 4/2009 |
| JP | 2010048465 | | | 3/2010 |
| JP | 2010054093 | | | 3/2010 |
| JP | 2010054099 | A | * | 3/2010 |
| JP | 2010065966 | | | 3/2010 |
| JP | 2010-117061 | A | | 5/2010 |
| JP | 2010255946 | | | 11/2010 |
| KR | 20-1991-0015193 | | | 9/1991 |
| KR | 1999-010024 | U | | 3/1999 |
| KR | 10-2006-0111999 | A | | 10/2006 |
| KR | 10-2007-0092524 | A | | 9/2007 |
| KR | 10-2008-0088850 | | | 10/2008 |
| KR | 10-2010-0061114 | A | | 6/2010 |
| WO | 2009011339 | A1 | | 1/2009 |
| WO | 2010024152 | A1 | | 3/2010 |

* cited by examiner

*Primary Examiner* — Robert A Hopkins
(74) *Attorney, Agent, or Firm* — McKenna Long & Aldridge LLP

(57) ABSTRACT

Disclosed is an air conditioner. The air conditioner includes a tray in which humidifying water is stored by a predetermined height, the tray being detachably attached to a main body, a humidifying gear rotatably arranged in the tray so as to be detachably attached to the tray, a lifter provided at a periphery of the humidifying gear, the lifter being submerged under the humidifying water so as to scoop up the humidifying water during rotation of the humidifying gear, and a humidifying filter provided in the humidifying gear and spaced apart from the humidifying water such that the humidifying water is supplied from the lifter to the humidifying filter during rotation of the humidifying gear.

12 Claims, 13 Drawing Sheets

AIR CONDITIONER

CROSS-REFERENCE TO RELATED APPLICATION

This application claims priority from Korean Patent Application No. 10-2010-0133742 filed on Dec. 23, 2010, Application No. 10-2010-0133743 filed on Dec. 23, 2010, Application No. 10-2010-0133744 filed on Dec. 23, 2010, and Application No. 10-2011-0002317 filed on Jan. 10, 2011, in the Korean Intellectual Property Office, the disclosure of which is incorporated herein by reference in its entirety.

BACKGROUND OF THE INVENTION

1. Field of the Invention

The present invention relates to an air conditioner, and more particularly, to an air conditioner having air purification and humidification functions.

2. Description of the Related Art

Generally, an air conditioner is designed to be mounted in a room or to communicate with a room through a duct and serves to filter various pollutants contained in indoor air, such as dust, gas, bad odor and smoke, for production of pleasant indoor environment.

Such an air conditioner includes a filter assembly to purify polluted air such that filtered pollutants are deposited on a filter and only purified air is again supplied into a room by means of a fan, etc. The filter assembly may further include a dehumidifying filter. An air conditioner having the dehumidifying filter can function to lower the humidity of humid indoor air in such a way that the dehumidifying filter absorbs moisture contained in the air.

However, the above described air conditioner cannot function to raise the humidity of air even if the air has low humidity. Therefore, there is a need for development of an air conditioner having both air purification and humidification functions.

SUMMARY OF THE INVENTION

An air conditioner in accordance with the present invention has the following one or more effects.

First, a humidifying filter is installed at a predetermined height so as to be spaced apart from humidifying water stored in a tray without a risk of submersion under the humidifying water. This eliminates a possibility of propagation of bacteria or mold in the humidifying filter, thus preventing contamination of the humidifying filter.

Second, such an installation height of the humidifying filter is determined in such a manner that a height from a bottom surface of the tray to the humidifying filter is greater than the highest storage height of the humidifying water, which positively prevents the humidifying filter from being submerged under the humidifying water.

Third, if a rotator is not rotated because a user humidification request is not input, a humidifying gear is stopped and a lifter is not operated to scoop up the humidifying water from the tray. In this way, if necessary, it is possible to stop supply of the humidifying water to the humidifying filter.

Fourth, if a blower fan is operated during humidification stoppage, purified dry air having passed through a filter assembly can be passed to the humidifying filter in which the humidifying water remains. Thereby, the wet humidifying filter may be dried by the dry air circulated by the blower fan.

Fifth, the humidifying gear is separably installed, which enables separation of the humidifying filter received in the humidifying gear. Thus, the humidifying filter may be replaced with a new one when contaminated or damaged.

Sixth, as a humidifying gear cover is separably coupled to a humidifying gear body, the humidifying filter is separable from the humidifying gear body after the humidifying gear cover is completely separated, which enables replacement of the humidifying filter.

Seventh, strong coupling between the humidifying gear cover and the humidifying gear body is accomplished owing to primary coupling between a coupling protrusion and a coupling recess thereof and auxiliary secondary coupling between the periphery of the humidifying gear body and the periphery of the humidifying gear cover.

Eighth, the humidifying gear is provided with a drain hole such that the humidifying water is supplied to the humidifying filter only during rotation of the humidifying gear. This eliminates a need to submerge the humidifying filter under the humidifying water, preventing contamination of the humidifying filter due to the humidifying water.

Ninth, with provision of a humidifying gear module as a replaceable substitute, if the humidifying gear module is contaminated by bacteria and the like, the humidifying gear module may be replaced with another humidifying gear module substitute, rather than being washed.

Effects of the present invention are not limited to the aforementioned effects, and other effects not mentioned will be clearly understood by those skilled in the art from the disclosure of the accompanying claims.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

The advantages and features of the present invention and the way of attaining them will become apparent with reference to embodiments described below in detail in conjunction with the accompanying drawings. Embodiments, however, may be embodied in many different forms and should not be constructed as being limited to example embodiments set forth herein. Rather, these example embodiments are provided so that this disclosure will be through and complete and will fully convey the scope to those skilled in the art. The scope of the present invention should be defined by the claims. Wherever possible, the same reference numbers will be used throughout the drawings to refer to the same or like parts.

Hereinafter, an air conditioner in accordance with the present invention will be described in detail with reference to the accompanying drawings. It will be understood that suffixes "module" and "unit" applied to elements used in the following description are used in consideration of ease of illustration and the suffixes themselves do not have discriminative meanings or roles.

Figure 1:
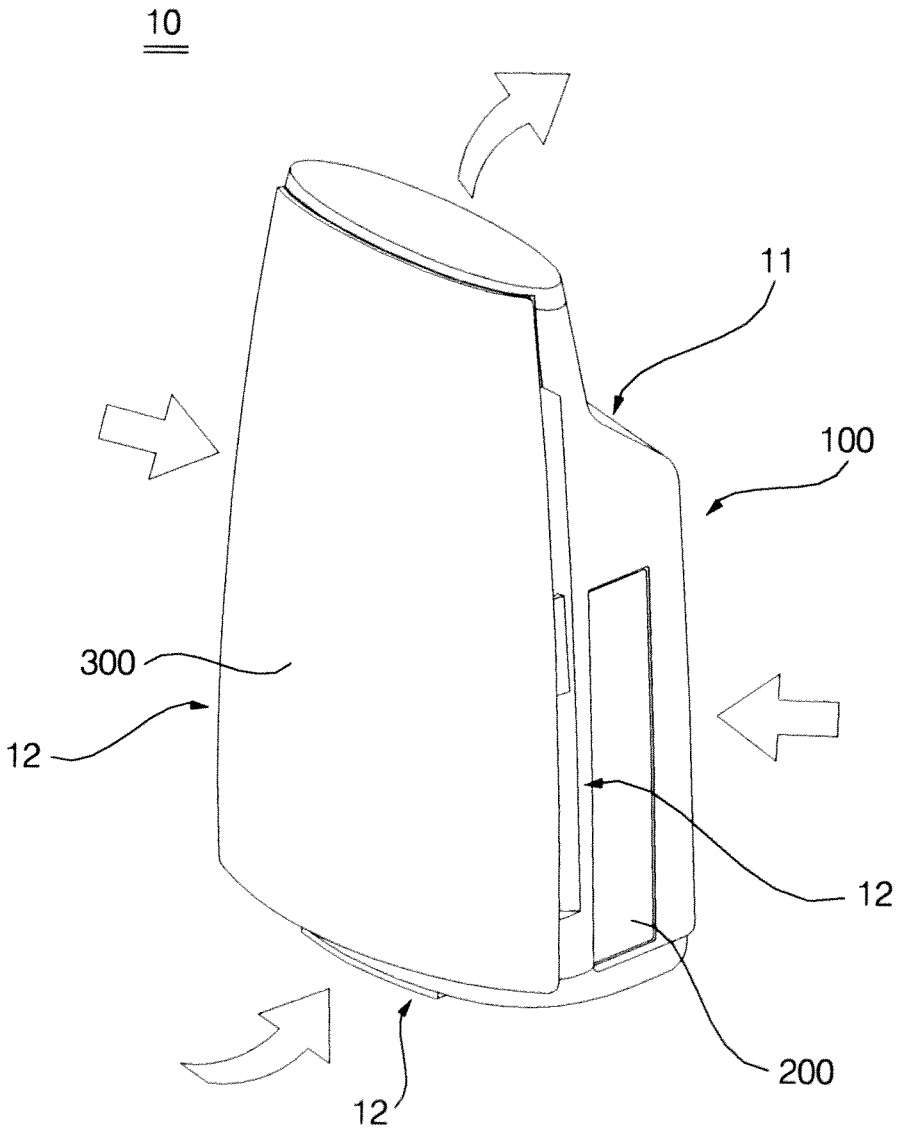
FIG. 1 is a perspective view illustrating an air conditioner in accordance with an embodiment of the present invention.
Figure 2:
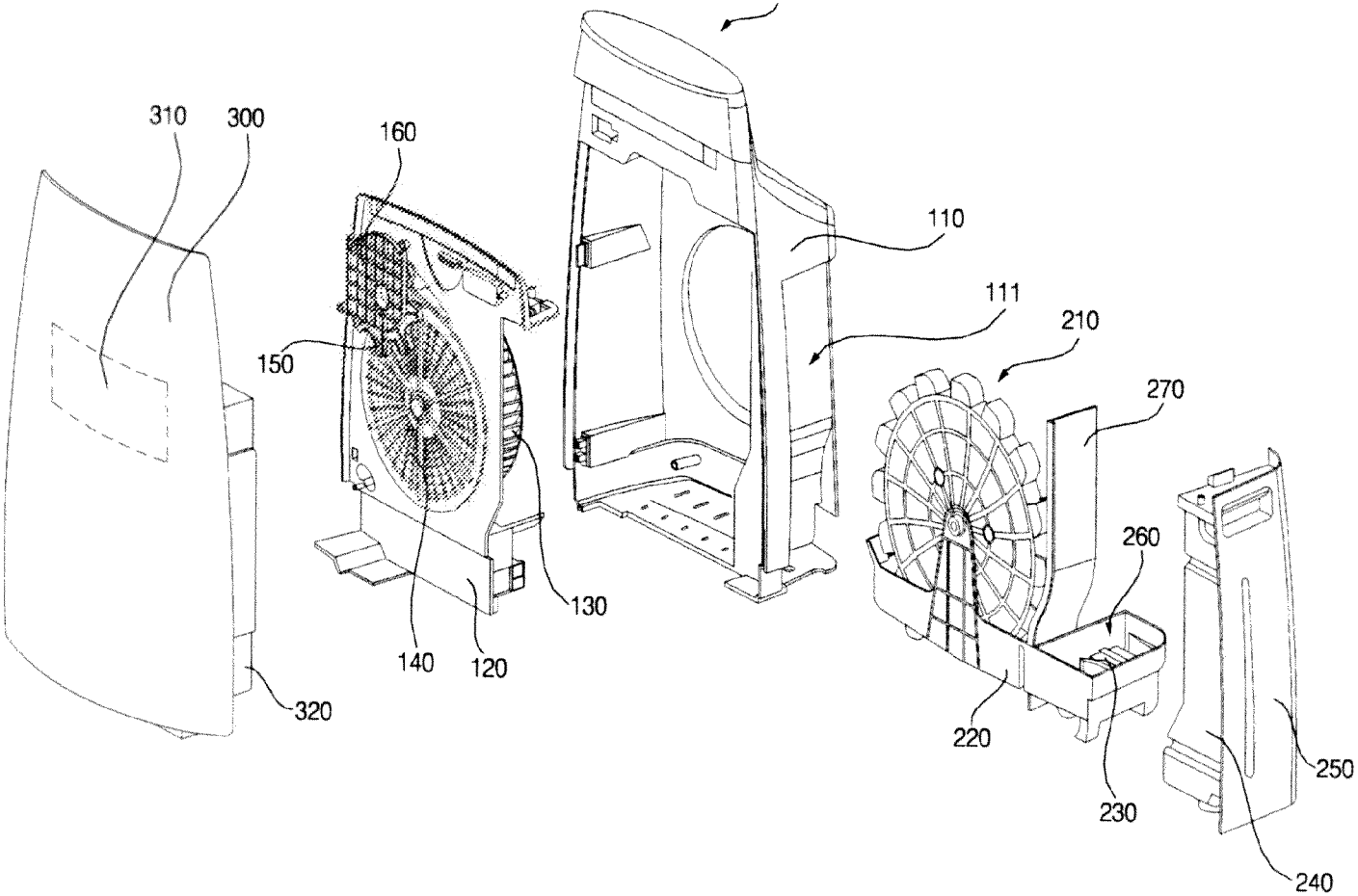
FIG. 2 is an exploded perspective view of the air conditioner illustrated in FIG. 1.

FIG. 1 is a perspective view illustrating an air conditioner in accordance with an embodiment of the present invention, and FIG. 2 is an exploded perspective view of the air conditioner illustrated in FIG. 1.

Referring to FIGS. 1 and 2, the air conditioner in accordance with the embodiment of the present invention includes a main body 100 in which a blower fan 130 to circulate air is received, a front panel 300 provided at the front side of the main body 100, and a humidifying gear assembly 200 separably installed in the main body 100.

The front panel 300 is coupled to one edge of the main body 100 so as to open or close the main body 100. Preferably, one edge of the front panel 300 is hinged to the main body 100. A hinge coupling unit A, which pivotally couples the front panel 300 to the main body 100, will be described later. If the front panel 300 is pivoted to open the main body 100, a filter assembly 320 provided at a rear surface of the front panel 300 is exposed to the outside.

The filter assembly 320 serves to filter pollutants contained in circulating air. The filter assembly 320 may be separably attached to the rear surface of the front panel 300. That is, the filter assembly 320 is arranged between the front panel 300 and the main body 100 and is hidden when the front panel 300 closes the main body 100.

In a state in which the front panel 300 closes the main body 100, there is a partial gap between the front panel 300 and the main body 100. The gap serves as an air suction port 12 through which air is suctioned when the blower fan 130 which will be described hereinafter is rotated to circulate air.

A display unit 310 to provide a user with visual information may be provided at a front surface of the front panel 300. The display unit 310 may be attached to the exterior of the front panel 300, or may be interposed between the front panel 300 and the filter assembly 320. Thus, visual information may be directly displayed on the display unit 310, or may be indirectly displayed through the front panel 300. In the latter case, the front panel 300 may be made of a semi-transparent material.

The main body 100 defines the external appearance of the air conditioner and receives a variety of constituent elements therein. The main body 100 includes a housing 110 defining the external appearance and an inner case 120 inserted into the housing 110.

The housing 110 accommodates the inner case 120 and the humidifying gear assembly 200 which will be described hereinafter. The housing 110 is provided with an air discharge port 11, through which the air suctioned through the air suction port 12 is discharged by operation of the blower fan 130. The air discharge port 11 may be perforated in a rear surface of the housing 110. In addition, a tray entrance/exit aperture 111 is perforated in a lateral surface of the housing 110 such that the humidifying gear assembly 200 is mounted into the housing 110 therethrough.

The blower fan 130 is rotatably installed to the inner case 120. The blower fan 130 is rotated by a fan drive unit (not shown) and serves to suction air through the air suction port 12 and circulates the suctioned air toward the air discharge port 11. The blower fan 130 may be located at one surface of the inner case 120, i.e. at an opposite surface of the filter assembly 320. In this case, the blower fan 130 allows the air suctioned through the air suction port 12 to pass through the filter assembly 320.

Air suctioned by rotation of the blower fan 130 is purified by the filter assembly 320. The purified air passes through a humidifying filter 280 which will be described hereinafter and thereafter, reaches the blower fan 130 through air circulation holes 140 perforated in the inner case 120. The blower fan 130 acts to discharge the air through the air discharge port 11.

A rotator 150 is rotatably installed to the inner case 120. The rotator 150 is rotated by a rotator drive unit (not shown) and is connected to a lifter (290 in FIG. 3) which will be described hereinafter when the humidifying gear assembly 200 is installed into the main body 100. The rotator 150 may be controlled so as to rotate only when a user humidification request is input. A rotator protector 160 may be provided at one surface of the rotator 150 and serve to shield the rotator 150 during rotation of the rotator 150 so as to protect the rotator 150 from damage.

The humidifying gear assembly 200 includes a tray 220 detachably attached to the main body 100, in which humidifying water is stored by a predetermined height, a plurality of lifters 290 provided at a periphery thereof so as to be connected to the rotator 150, and a humidifying gear module rotatably arranged in the tray 220 so as to be rotated upon receiving rotational force of the rotator 150. In an embodiment, the humidifying gear module may be separably provided in the tray 220.

The tray 220 stores the humidifying water. A water tank 240 is mounted in a partial region of the tray 220 to supply the humidifying water into the tray 220 to a predetermined height. Here, the water tank 240 is separably mounted in the partial region of the tray 220. A water tank cover 250 may be provided at one side of the water tank 240 to shield the water tank 240 while defining the external appearance of the water tank 240.

To receive the water tank 240, the tray 220 defines a water tank receptacle 260 therein. The water tank receptacle 260 contains a float 230 connected to the water tank 240. As water is supplied from the water tank 240 into the tray 220 through the float 230, the humidifying water is stored in the tray 220.

The float 230 connected to the water tank 240 also serves to prevent supply of the water from the water tank 240 if the humidifying water stored in the tray 220 reaches a predetermined height. In this case, a particular height at which the humidifying water is stored to the maximum extent is referred to as the highest water storage height h, which is measured from a bottom surface of the tray 220 to the surface of the humidifying water.

A humidifying gear 210 is rotatably mounted in a partial region of the tray 220. The humidifying gear 210 may be separable from the tray 220. A partition 270 may be provided between the humidifying gear 210 and the water tank 240 to isolate the humidifying gear 210 and the water tank 240 from each other.

The humidifying gear module is constituted by the humidifying gear 210, which is rotatably arranged in the tray 220 so as to be rotated upon receiving rotational force of the rotator 150, the lifters 290 provided at a periphery of the humidifying gear 210, and a humidifying filter (280 in FIG. 4) provided inside the humidifying gear 210. The humidifying gear 210, the lifters 290 and the humidifying filter 280 constituting the humidifying gear module may be integrally formed with each other, or may be separately provided.

In one embodiment wherein the humidifying gear 210, the humidifying filter 280 and the lifters 290 are integrally formed with one another, the humidifying gear module may constitute a single structure separably coupled to the tray 220. The humidifying gear module may be fabricated as a replaceable substitute. In this case, if the humidifying gear module is contaminated by bacteria and the like, the contaminated humidifying gear module may be replaced with another humidifying gear module substitute, rather than being washed.

In another embodiment of the humidifying gear module, the humidifying gear 210, the lifters 290 and the humidifying filter 280 may be separately provided so as to be separated from one another. Although it will be described hereinafter that the lifters 290 are provided at the humidifying gear 210 and the humidifying gear 210 and the humidifying filter 280 are separately provided, the embodiment of the humidifying gear module is not limited thereto.

The humidifying gear 210 is provided at the periphery thereof with the lifters 290. The humidifying gear assembly 200 is connected to the rotator 150 when coupled to the main body 100. If the rotator 150 is rotated, the lifters 290 are rotated by the rotator 150, causing the humidifying gear 210 to be rotated.

Figure 3:
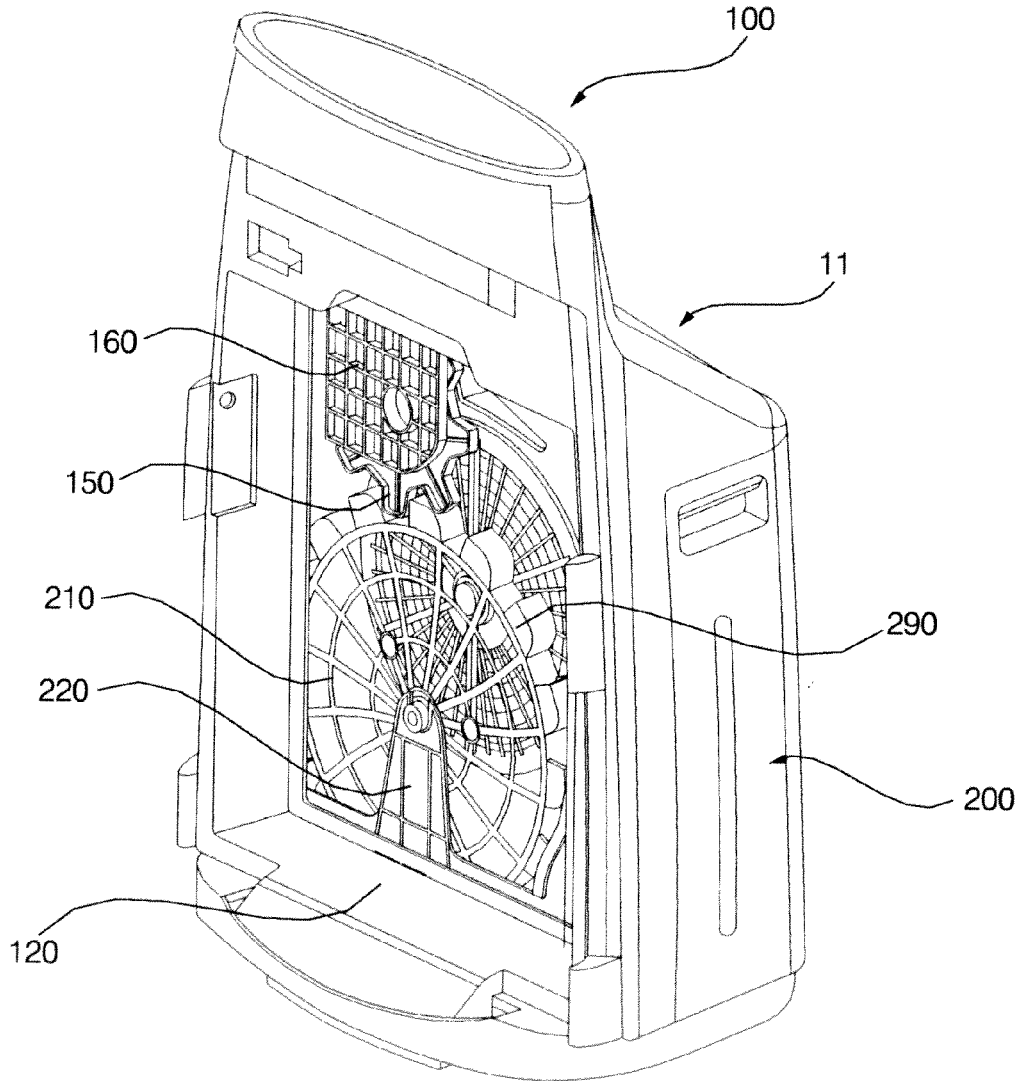
FIG. 3 is a view illustrating a humidifying gear assembly installed in a main body.
Figure 4:
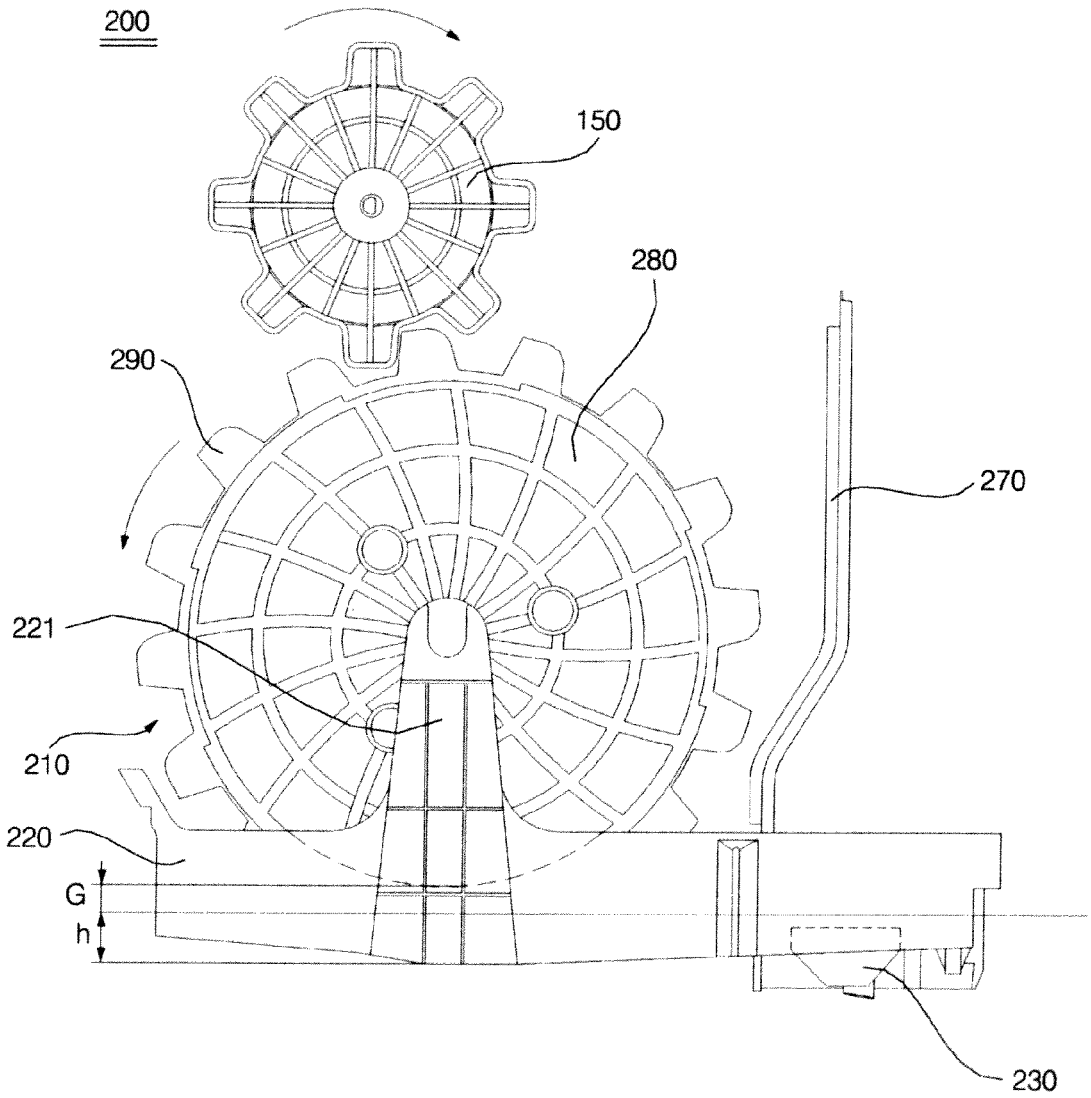
FIG. 4 is a front view of a rotator and the humidifying gear assembly illustrated in FIG. 3.

FIG. 3 is a view illustrating the humidifying gear assembly 200 installed in the main body 200, and FIG. 4 is a front view of the rotator 150 and the humidifying gear assembly 200 illustrated in FIG. 3.

Referring to FIGS. 3 and 4, the air conditioner in accordance with the embodiment of the present invention includes the rotator 150 rotatably arranged in the main body 100, the tray 220 in which the humidifying water is stored by a predetermined height, the humidifying gear 210 rotatably arranged in the tray 220 so as to be rotated upon receiving rotational force of the rotator 150, the lifters 290 provided at the periphery of the humidifying gear 210, the lifters 290 being connected to the rotator 150 when the tray 220 is attached to the main body 100 and being partially submerged under the humidifying water so as to scoop up the humidifying water during rotation of the rotator 150, and the humidifying filter 280 provided inside the humidifying gear 210, the humidifying filter 280 being spaced apart from the humidifying water such that the humidifying water is supplied from the lifters 290 to the humidifying filter 280 during rotation of the humidifying gear 210.

The rotator 150 is rotatably arranged in the inner case 120 of the main body 100 and is rotated only when a user humidification request is input. The rotator 150 is connected to the lifters 290 provided at the periphery of the humidifying gear 210 when the humidifying gear assembly 200 is coupled to the main body 100. The rotator 150 may have teeth protruding from a periphery thereof. The lifters 290 of the humidifying gear 210 connected to the rotator 150 may have a shape corresponding to that of the teeth of the rotator 150.

When the humidifying gear assembly 200 is coupled to the main body 100, the humidifying gear 210 is connected to the rotator 150. In this case, to enable connection between the humidifying gear 210 and the rotator 150, the lifters 290 must have a shape corresponding to that of the teeth of the rotator 150. Accordingly, the lifters 290 may have a size and interval corresponding to those of the teeth of the rotator 150 to enable connection between the rotator 150 and the humidifying gear 210. The lifters 290 and the rotator 150 may be engaged with each other by gear coupling.

The humidifying gear 210 is rotatably arranged in the tray 220 and is separable from the tray 220. The humidifying gear 210 may be separably coupled to a humidifying gear support 221 protruding from the tray 220.

Some of the lifters 290 are submerged under the humidifying water stored in the tray 220. In this case, a storage height of the humidifying water in the tray 220 is controlled by the float 230. More specifically, under the condition of the highest water storage height h, some of the lifters 290 provided at the periphery of the humidifying gear 210 are submerged under the humidifying water. If the rotator 150 begins to rotate in such a state, the humidifying gear 210 and the lifters 290 connected to the rotator 150 are rotated upon receiving rotational force of the rotator 150 and the lifters 290 submerged under the humidifying water act to scoop up the humidifying water upon receiving rotational force of the rotator 150.

The humidifying filter 280 is provided inside the humidifying gear 210. The humidifying water scooped up by the lifters 290 during rotation of the humidifying gear 210 is supplied to the humidifying filter 280, causing the humidifying filter 280 to wet.

The lifters 290 are moved during rotation of the rotator 150. If the rotator 150 is rotated, the humidifying gear 210 is rotated, causing the lifters 290 provided at the periphery of the humidifying gear 210 to bee rotated. Thereby, the lifters 290 scoop up the humidifying water during rotation of the rotator 150, supplying the humidifying water to the humidifying filter 280.

In a state in which the humidifying filter 280 is rotated by rotation of the humidifying gear 210, the purified air having passed through the filter assembly 320 passes through the humidifying filter 280 by rotation of the blower fan 130. As the air absorbs the humidifying water contained in the humidifying filter 280 while passing through the humidifying filter 280, the air is changed into highly humid air. The resulting humid air is discharged through the air discharge port 11 by rotation of the blower fan 130, thereby acting to humidify outside air.

The humidifying filter 280 is spaced apart from the humidifying water stored in the tray 220 by a predetermined height G. Specifically, a height from the bottom surface of the tray 220 to the humidifying filter 280 is greater than the highest water storage height h of the humidifying water. If the air conditioner is operated in a state in which the humidifying filter 280 is submerged under the humidifying water stored in the tray 220, this may cause contamination of the humidifying filter 280. For this reason, the humidifying filter 280 in accordance with the embodiment of the present invention is upwardly spaced apart from the highest water storage height h by the predetermined height G so as not to be submerged under the humidifying water.

The lifters 290 are rotated to supply the humidifying water to the humidifying filter 280 only during rotation of the humidifying gear 210. Specifically, the humidifying filter 280 is spaced apart from the humidifying water stored in the tray 220 and does not come into contact with the humidifying water even if the humidifying water reaches the highest water storage height h, which prevents the humidifying water stored in the tray 220 from being directly supplied to the humidifying filter 280.

Thus, the humidifying water is supplied to the humidifying filter 280 only during rotation of the humidifying gear 210. The humidifying water scooped up by the lifters 290 falls over the humidifying filter 280 as the humidifying gear 210 is rotated by an angle such that the lifters 290 are angled with respect to the ground. Since the humidifying filter 280 is arranged so as not to be submerged under the humidifying water stored in the tray 220, it is possible to prevent contamination of the humidifying filter 280 due to propagation of bacteria or mold caused when the humidifying filter 280 is submerged under the humidifying water.

In addition, in the case where the rotator 150 is not rotated because a user humidification request is not input, the humidifying gear 210 is stopped. The lifters 290 do not scoop up the humidifying water while the humidifying gear 210 is stopped, stopping supply of the humidifying water to the humidifying filter 280. If the blower fan 130 is operated during humidification stoppage, the purified dry air having passed through the filter assembly 320 passes through the humidifying filter 280 by operation of the blower fan 130.

In this case, the humidifying filter 280 in which the humidifying water remains may be dried by the dry air circulated by the blower fan 130, which prevents propagation of bacteria and contamination of the humidifying filter 280 due to the humidifying water remaining in the humidifying filter 280.

The humidifying gear assembly 200 or the inner case 120 may be provided with a water plasma device (not shown). Although the water plasma device will be described hereinafter as being provided at one side of the inner case 120, the embodiment of the water plasma device is not limited thereto. The water plasma device is arranged to come into contact with the humidifying water stored in the tray 220. The water plasma device functions to sterilize the humidifying water stored in the tray 220 upon receiving power.

Figure 5:
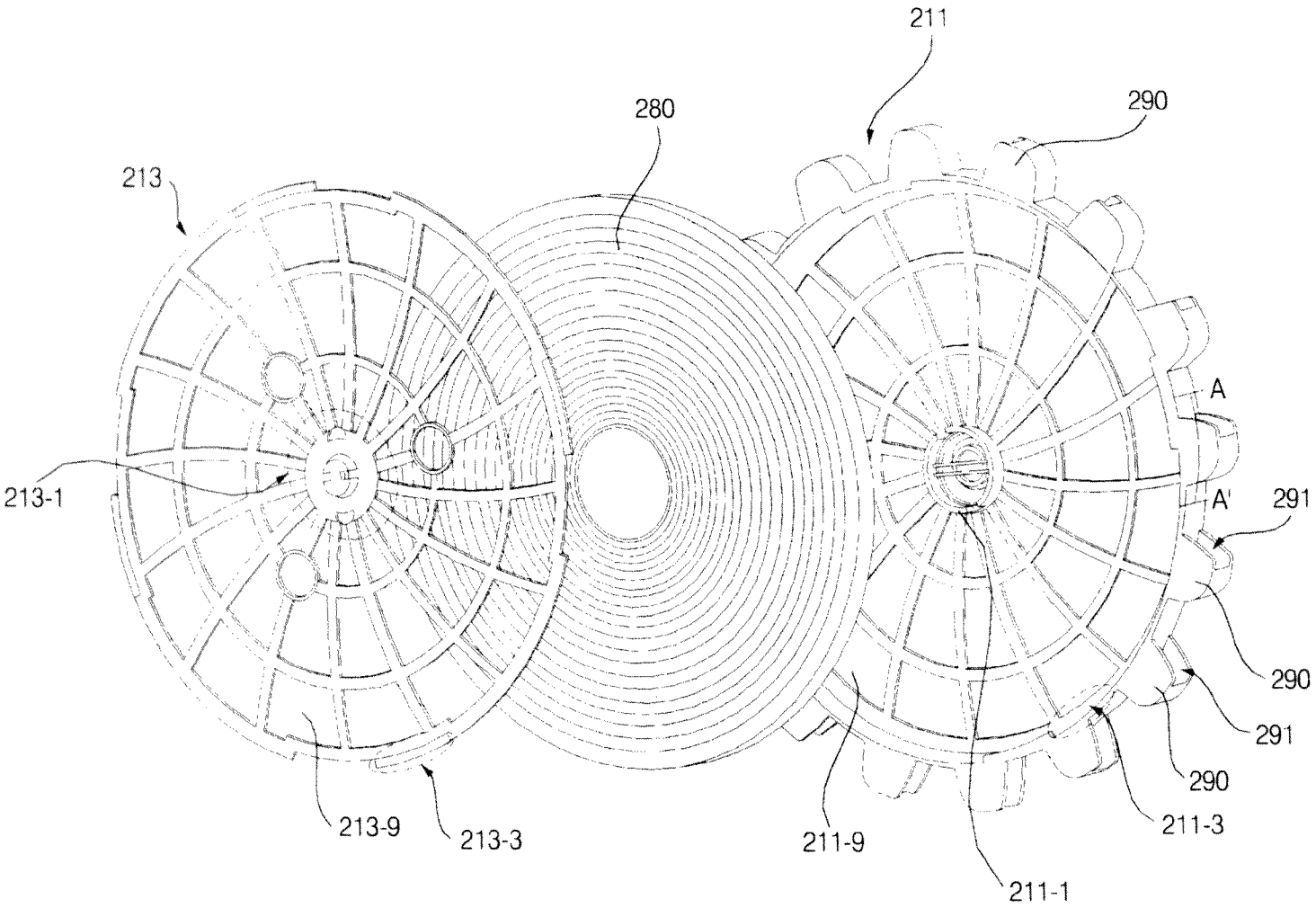
FIG. 5 is a perspective view illustrating the interior configuration of a humidifying gear.
Figure 6:
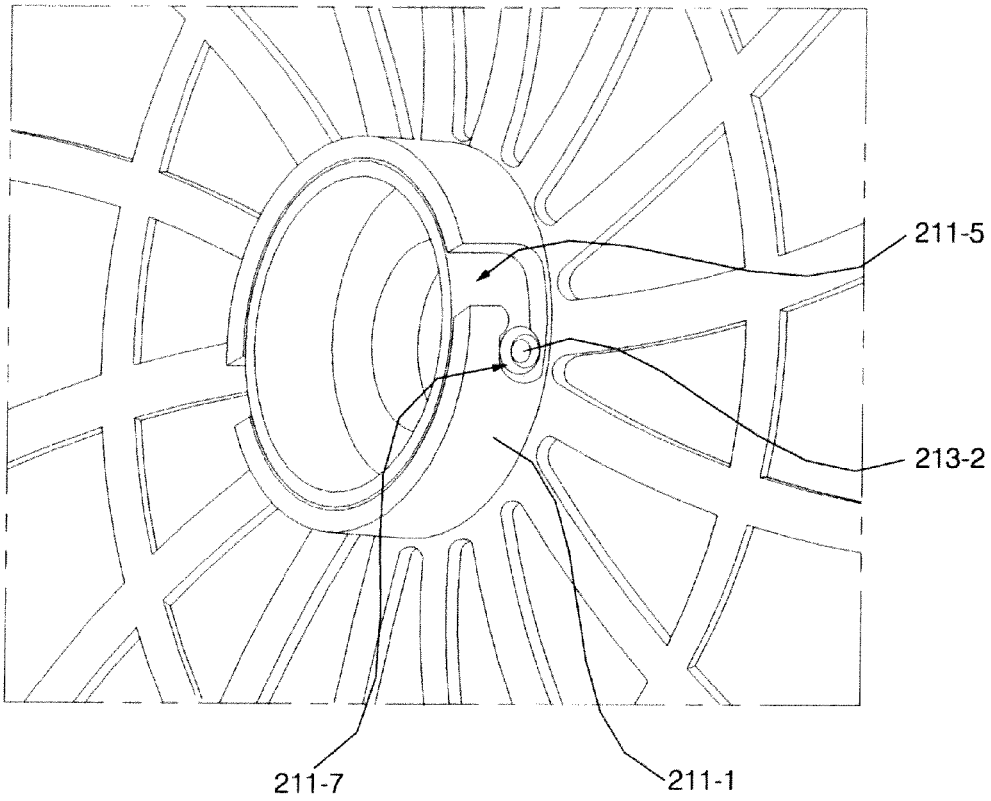
FIG. 6 is a perspective view illustrating a central portion of a humidifying gear body and a central portion of a humidifying gear cover.

FIG. 5 is a perspective view illustrating the interior configuration of the humidifying gear 210, FIG. 6 is a perspective view illustrating a central portion 211-1 of a humidifying gear body 211 and a central portion 213-1 of a humidifying gear cover 213. Also, FIG. 7 is a perspective view illustrating the periphery of the humidifying gear body 211 and the periphery of the humidifying gear cover 213.

Figure 7:
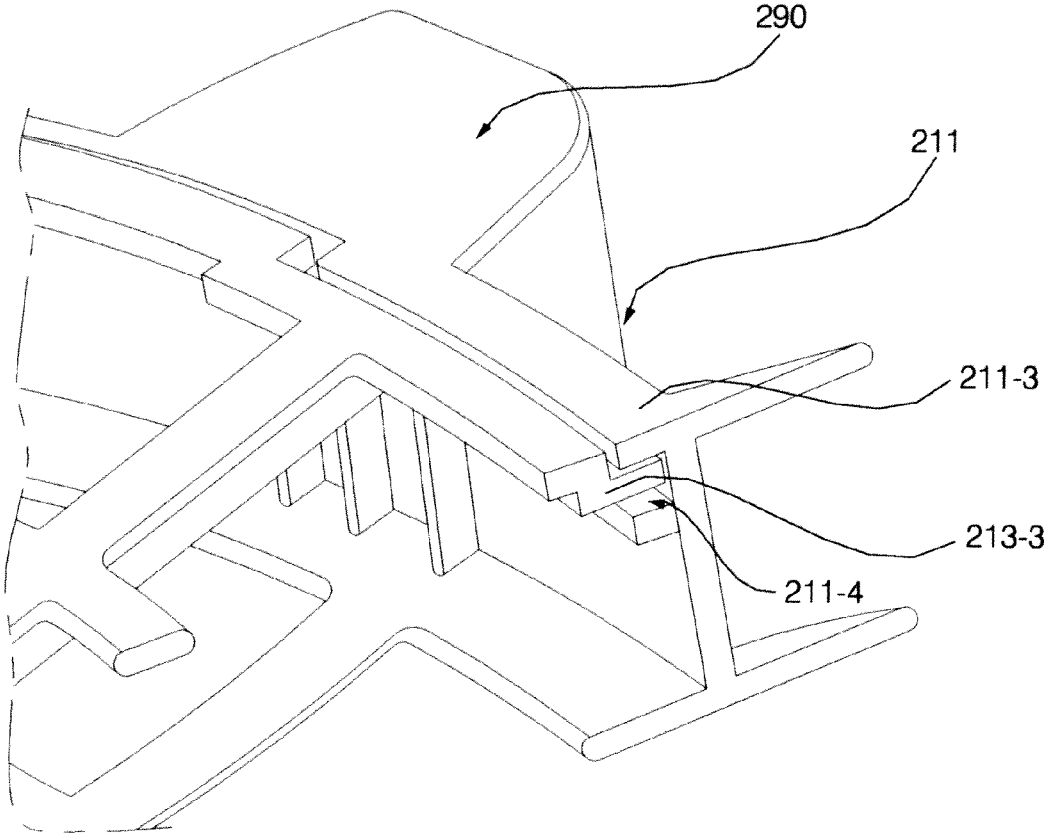
FIG. 7 is a perspective view illustrating the periphery of the humidifying gear body and the periphery of the humidifying gear cover.

Referring to FIGS. 5 to 7, the humidifying gear 210 in accordance with the embodiment of the present invention may include two or more constituent elements and the humidifying filer 280 may be provided inside the humidifying gear 210. A diameter of the humidifying filter 280 is less than a diameter of the humidifying gear 210 and thus, the humidifying filter 280 is received inside the humidifying gear 210. Providing the humidifying filter 280 with the smaller diameter than that of the humidifying gear 210 ensures that the humidifying filter 280 is spaced apart from the humidifying filter even if the humidifying gear 210 is submerged under the humidifying water. As such, the humidifying filter 280 can remain dry.

The humidifying filter 280 may be made of a material suitable to evaporate and absorb moisture, which allows the humidifying filter 280 to contain the humidifying water and supply the humidifying water to the air circulated by the blower fan 130. Preferably, the humidifying filter 280 is made of a fabric material. In an embodiment, the humidifying filter 280 may be made of various synthetic resins.

In one embodiment, the humidifying gear 210 may be integrally formed with the humidifying filter 280. If the humidifying gear 210 is integrally formed with the humidifying filter 280, the humidifying gear module may be separated from the tray 220 when contaminated or used for a long time and a new humidifying gear module may be mounted into the tray 220.

In another embodiment, constituent elements of the humidifying gear 210 may be separably provided to allow the humidifying filter 280 to be separated from the humidifying gear 210. With the separable configuration of the humidifying gear 210, the humidifying filter 280 received inside the humidifying filter 280 may be separated and be replaced with a new humidifying filter 280 when contaminated or damaged.

The humidifying gear 210 in accordance with the embodiment of the present invention includes the humidifying gear body 211, which is provided with the lifters 290 and is configured to receive the humidifying filter 280 therein, and the humidifying gear cover 213 which is separably coupled to the humidifying gear body 211 so as to fix the humidifying filter 280 received inside the humidifying gear body 211.

The humidifying gear body 211 defines the body of the humidifying gear 210 and is provided at a periphery thereof with the lifters 290. In an embodiment, the lifters 290 may be integrally formed with the humidifying gear body 211. Alternatively, the lifters 290 may be separately provided and coupled to the periphery of the humidifying gear body 211. Although the lifters 290 will be described hereinafter as protruding from the periphery of the humidifying gear body 211, the embodiment of the lifters 290 is not limited thereto.

The humidifying filter 280 is received in the humidifying gear body 211. The humidifying gear body 211 may include a recess to receive the humidifying filter 280. As such, the humidifying filter 280 is received in the humidifying gear 210 and is separably coupled to the humidifying gear body 211.

The humidifying gear cover 213 is separably coupled to the humidifying gear body 211. The humidifying gear cover 213 is coupled to one side of the humidifying gear body 211 so as to support one surface of the humidifying gear filter 280 received in the humidifying gear body 211. If the humidifying gear cover 213 is separated from the humidifying gear body 211, the humidifying filter 280 received in the humidifying gear body 211 is exposed to the outside. After the humidifying gear cover 213 is completely separated, the humidifying filter 280 is separable from the humidifying gear body 211 so as to be replaced with a new one.

Any one of the humidifying gear body 211 and the humidifying gear cover 213 is provided with an open coupling recess 211-5 and the other one of the humidifying gear body 211 and the humidifying gear cover 213 is provided with a coupling protrusion 213-2 configured to be separably inserted into the coupling recess 211-5. Although it will be described hereinafter that the coupling recess 211-5 is indented in the humidifying gear body 211 and the coupling protrusion 213-2 is formed at the humidifying gear cover 213, positions of the coupling recess 211-5 and the coupling protrusion 213-2 are not limited thereto. If the coupling protrusion 213-2 is inserted into the coupling recess 211-5, the humidifying gear cover 213 and the humidifying gear body 211 are coupled to each other, thereby fixing the humidifying filter 280 received therebetween.

The coupling recess 211-5 may be formed in the central portion 211-1 of the humidifying gear body 211. In an embodiment, if the coupling protrusion 213-2 is formed at the humidifying gear body 211, the coupling recess 211-5 may be formed in the central portion 213-1 of the humidifying gear cover 213. Although it will be described hereinafter that the coupling recess 211-5 is formed in the central portion 211-1 of the humidifying gear body 211 and the coupling protrusion 213-2 is formed at the central portion 213-1 of the humidifying gear cover 213, the embodiment of the coupling protrusion 213-2 and the coupling recess 211-5 is not limited thereto. If the coupling protrusion 213-2 is inserted into the coupling recess 211-5, the central portion 211-1 of the humidifying gear body 211 and the central portion 213-1 of the humidifying gear body 213 are coupled to each other, thereby acting to fix the humidifying filter 280 therebetween.

After the coupling protrusion 213-2 is inserted into the coupling recess 211-5, the coupling protrusion 213-2 is rotated, thereby being fixed to a fixing recess 211-7 formed at one end of the coupling recess 211-5. More specifically, in a state in which the central portion 213-1 of the humidifying gear cover 213 is aligned with the central portion 211-1 of the humidifying gear body 211, the coupling protrusion 213-2 is inserted into the coupling recess 211-5. The inserted coupling protrusion 213-2 is rotated in the coupling recess 211-5 as the humidifying gear cover 213 is rotated, thereby being inserted into the fixing recess 211-7 formed at one end of the coupling recess 211-5. As the coupling protrusion 213-2 is finally fixed to the fixing recess 211-7, strong coupling between the humidifying gear body 211 and the humidifying gear cover 213 is accomplished.

The periphery of the humidifying gear body 211 and the periphery of the humidifying gear cover 213 are separably coupled to each other. When the humidifying gear cover 213 is coupled to the humidifying gear body 211, the inner periphery of the humidifying gear body 211 is engaged with the outer periphery of the humidifying gear cover 213. In this case, as the central portion 213-1 of the humidifying gear cover 213 and the central portion 211-1 of the humidifying gear body 211 are primarily coupled to each other by the coupling protrusion 213-2 and the coupling recess 211-5 and then, the periphery of the humidifying gear cover 213 and the periphery of the humidifying gear body 211 are secondarily engaged with each other. As a result that the secondary coupling between the periphery of the humidifying gear body 211 and the periphery of the humidifying gear cover 213 assists coupling between the coupling protrusion 213-2 and the coupling recess 211-5, more strong coupling between the humidifying gear cover 213 and the humidifying gear body 211 is accomplished.

A separable coupling configuration between the periphery of the humidifying gear cover 213 and the periphery of the humidifying gear body 211 may be realized according to various embodiments. Although it will be described hereinafter that any one of the periphery of the humidifying gear body 211 and the periphery of the humidifying gear cover 213 is provided with a sliding insertion groove 211-3 and the other periphery is provided with a sliding insert 213-3 configured to be inserted into the sliding insertion groove 211-3 to enable separable coupling between the periphery of the humidifying gear body 211 and the periphery of the humidifying gear cover 213, the embodiment of the sliding insertion groove 211-3 and the sliding insert 213-3 is not limited thereto.

The sliding insertion groove 211-3 may be indented in any one of the periphery of the humidifying gear cover 213 and the periphery of the humidifying gear body 211. Although the sliding insertion groove 211-3 will be described hereinafter as being indented in the periphery of the humidifying gear body 211, the embodiment of the sliding insertion groove 211-3 is not limited thereto. The sliding insert 213-3 is inserted into the sliding insertion groove 211-3. More specifically, a plurality of sliding insertion grooves 211-3 may be spaced apart from one another along the periphery of the humidifying gear body 211.

The sliding insert 213-3 is formed at the periphery of the humidifying gear cover 213 according to the above described embodiment. More specifically, a plurality of sliding inserts 213-3 may be arranged on the periphery of the humidifying gear cover 213. The sliding inserts 213-3 are located to correspond to the respective sliding insertion grooves 211-3.

Hereinafter, a coupling relationship between the sliding insertion groove 211-3 and the sliding insert 213-3 will be described. When the coupling protrusion 213-2 is inserted into the coupling recess 211-5, the sliding insert 213-3 is inserted into the sliding insertion groove 211-3. That is to say, the coupling recess 211-5 and the sliding insertion groove 211-3 respectively correspond to the coupling protrusion 213-2 and the sliding insert 213-3 to realize simultaneously insertion thereof.

When the coupling protrusion 213-2 is fixed to the fixing recess 211-7, the sliding insert 213-3 slides in the sliding insertion groove 211-3. If the humidifying gear cover 213 is rotated relative to the humidifying gear body 211 in a state in which the coupling protrusion 213-2 and the sliding insert 213-3 are respectively inserted into the coupling recess 211-5 and the sliding insertion groove 211-3, the coupling protrusion 213-2 is caught by the fixing recess 211-7. Simultaneously, the sliding insert 213-3 is inserted into a sliding coupling groove 211-4 formed at one end of the sliding insertion groove 211-3. The sliding coupling groove 211-4 may be configured to allow the sliding insert 213-3 to be fixed inside the periphery of the humidifying gear body 211.

As the coupling protrusion 213-2 is coupled into the fixing recess 211-7, the humidifying gear cover 213 is primarily fixed to the humidifying gear body 211. Also, as the sliding insert 213-3 is coupled into the sliding coupling groove 211-4, the humidifying gear cover 213 is secondarily coupled to the humidifying gear body 211. In this way, strong coupling between the humidifying gear body 211 and the humidifying gear cover 213 is realized and also, easy replacement of the humidifying filter 280 is possible.

The humidifying gear body 211 and/or the humidifying gear cover 213 are provided with a plurality of openings 211-9 for air circulation. When the rotator 150 is rotated to rotate the humidifying gear 210, the plurality of openings 211-9 is perforated in the humidifying gear body 211 and/or the humidifying gear cover 213 to allow the air to pass through the humidifying gear 210 and the humidifying filter 280 by rotation of the blower fan 130. As the air having passed through the openings 211-9 passes through the humidifying filter 280, the air may be changed into humid air by the humidifying water remaining in humidifying filter 280 and then, be again introduced into a room.

Figure 8:
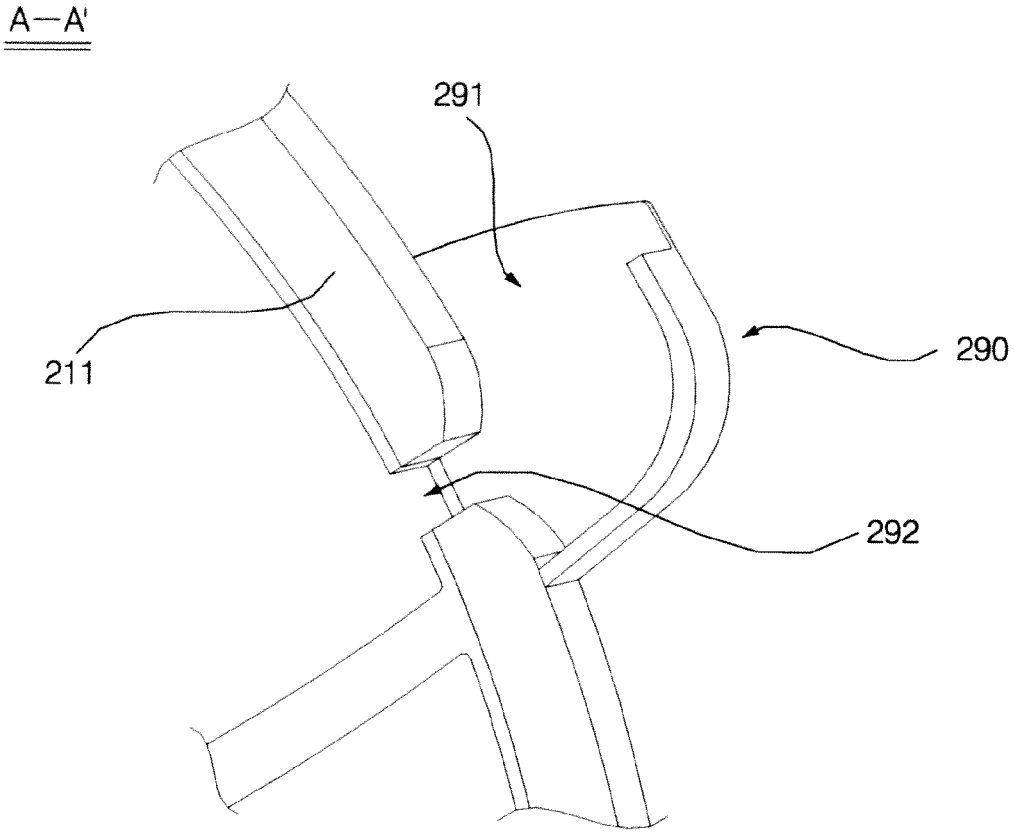
FIG. 8 is a sectional view taken along the line A-A'illustrated in FIG. 5.

FIG. 8 is a sectional view taken along the line A-A' illustrated in FIG. 5.

Referring to FIGS. 5 and 8, the lifters 290, as described above, are provided at the periphery of the humidifying gear 210 and each lifter 290 has a recessed portion 291 to scoop up the humidifying water. If the humidifying gear 210 is rotated, the lifter 290 submerged under the humidifying water is rotated such that the recessed portion 291 of the lifter 290 scoops up the humidifying water. The scooped humidifying water falls over the humidifying filter 280 if the humidifying gear 210 is rotated such that the lifter 290 is angled with respect to the ground.

The recessed portion 291 is provided at a surface thereof with a drain hole 292 through which the scooped humidifying water is supplied to the humidifying filter 280. The drain hole 292 is perforated in the humidifying gear body 211. In an embodiment, the drain hole 292 may be perforated in a peripheral position of the humidifying gear body 211 corresponding to the recessed portion 291.

The humidifying water scooped up by the recessed portion 291 falls down through the drain hole 292 as the humidifying gear 210 is rotated by a certain angle, thereby being moved to the humidifying filter 280 provided inside the humidifying gear 210. As such, the humidifying water, which is scooped up by the recessed portion 291 of the lifter 290, is moved to the humidifying filter 280 through the drain hole 292 only during rotation of the humidifying gear 210.

As the humidifying water is supplied to the humidifying filter 280 through the drain hole 292 formed in the humidifying gear 210 only during rotation of the humidifying gear 210, it is unnecessary to submerge the humidifying filter 280 under the humidifying water, which can prevent contamination of the humidifying filter 280 due to the humidifying water.

Figure 9:
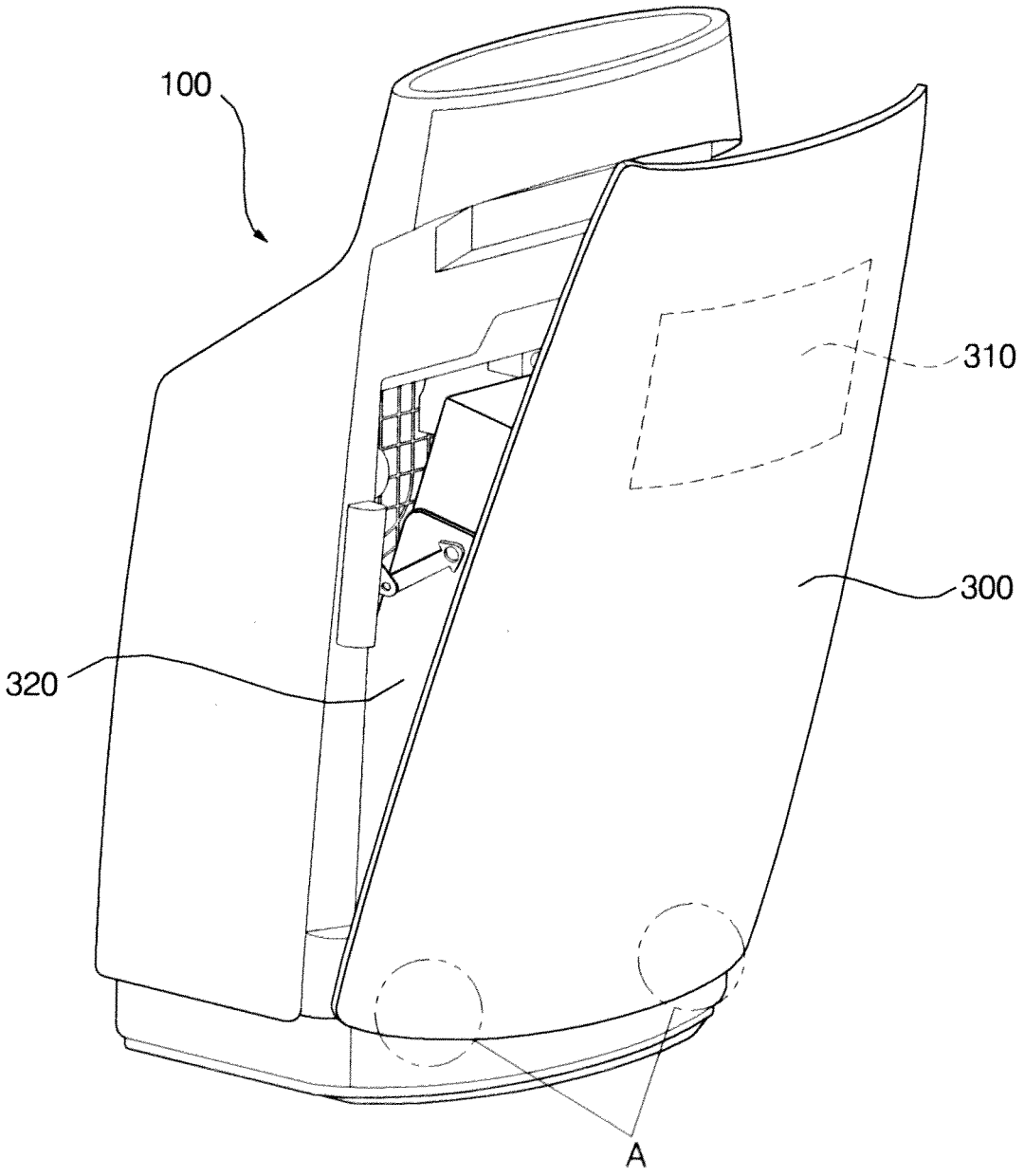
FIG. 9 is a view illustrating an open state of a front panel.
Figure 10:
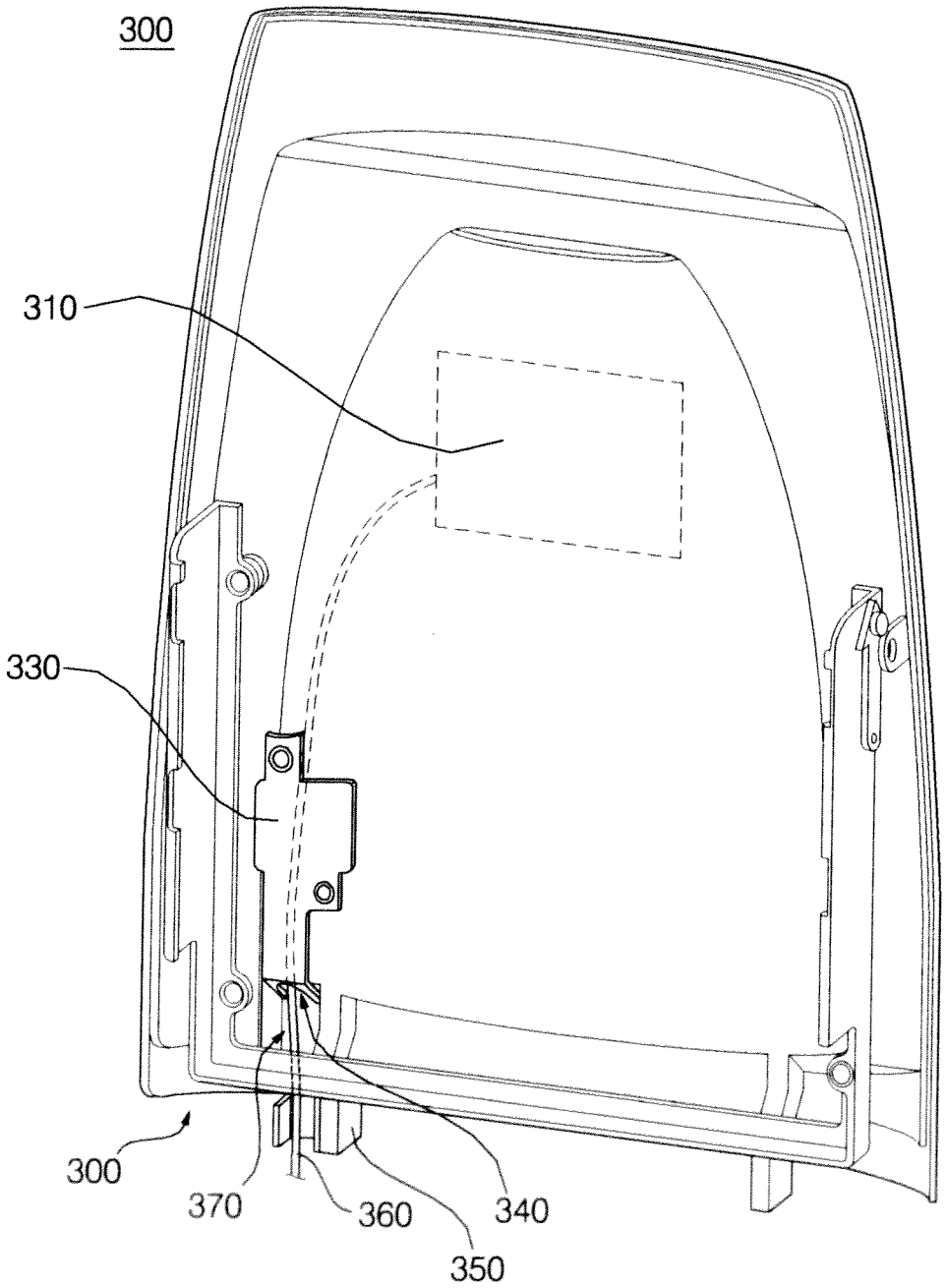
FIG. 10 is a view illustrating a rear surface of the front panel in accordance with an embodiment of the present invention.
Figure 11:
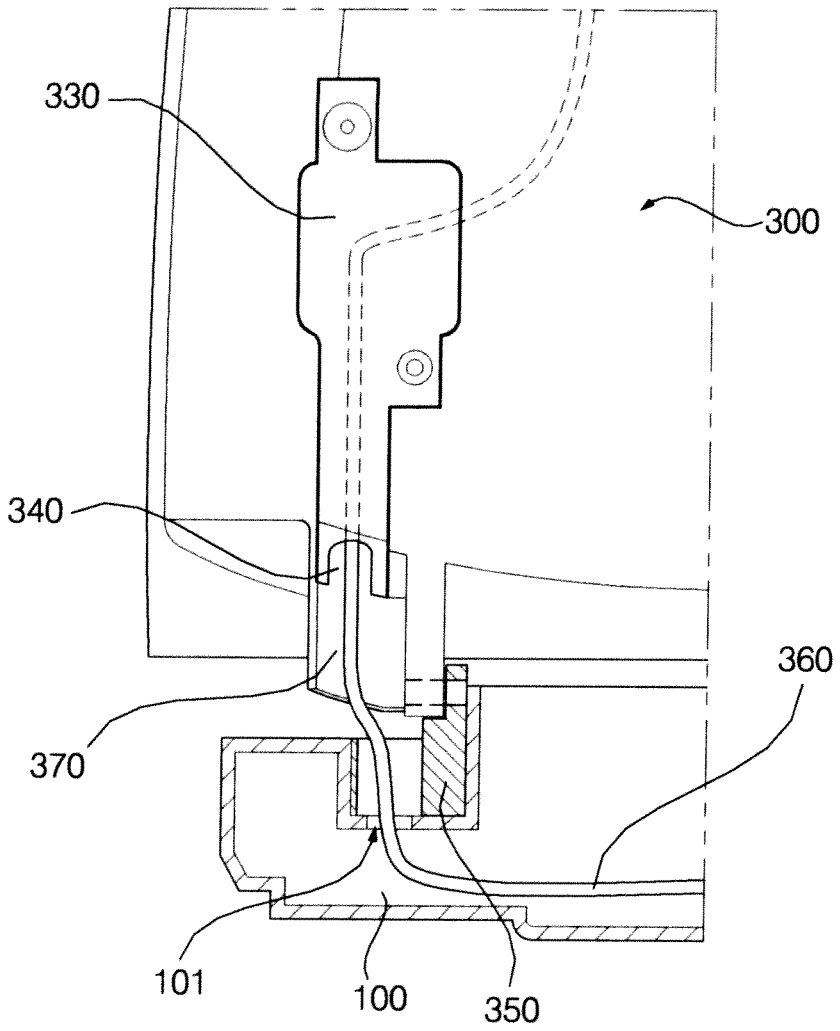
FIG. 11 is a view illustrating a hinge coupling unit in accordance with an embodiment of the present invention.

FIG. 9 is a view illustrating an open state of the front panel 300, FIG. 10 is a view illustrating the rear surface of the front panel 300 in accordance with an embodiment of the present invention, and FIG. 11 is a view illustrating the hinge coupling unit A.

Referring to FIGS. 9 to 11, the main body 100 and the front panel 300 are pivotally coupled to each other by the hinge coupling unit A. In an embodiment, the hinge coupling unit A allows a lower end of the front panel 300 to be hinged to a lower end of the main body 100. The hinge coupling unit is represented in FIG. 9 by reference letter A and may be formed at a plurality of positions. If the front panel 300 is forwardly pivoted to open the main body 100, the filter assembly 320 provided at the rear surface of the front panel 300 and the interior of the main body 100 are exposed to the outside in a state in which the lower end of the front panel 300 is coupled to the lower end of the main body 100 by the hinge coupling unit A.

In the embodiment of the present invention as illustrated in FIGS. 10 and 11, the hinge coupling unit A includes an opening 101 formed in a position of the main body 100, a cable harness 360 pivotally provided at one side of the front panel 300 so as to be connected to both the front panel 300 and the main body 100, and a coupling bridge 350 inserted into the opening 101 so as to be secured to the main body 100, the coupling bridge 350 serving to pivotally couple the main body 100 and the front panel 300 to each other and being configured to accommodate the cable harness 360 therein.

The opening 101 is perforated in a certain position of the main body 100. The opening 101 of the main body 100 provides a passage for insertion of the coupling bridge 350 which will be described hereinafter and for penetration of the cable harness 360 which will be described hereinafter. The opening 101 has a shape corresponding to the coupling bridge 350 to enable smooth insertion of the coupling bridge 350 and is positioned at a lower surface of the main body 100.

The coupling bridge 350 may be pivotally provided at one side of the front panel 300. In this case, the coupling bridge 350 may allow one side of the front panel 300 to be pivotally hinged to the main body 100. In a state in which the coupling bridge 350 is hinged to one side of the front panel 300, the coupling bridge 350 is inserted through the opening 101 and is secured to the main body 100. With hinge coupling between the coupling bridge 350 secured to the main body 100 and the front panel 300, the front panel 300 may be pivoted to open or close the main body 100.

In an embodiment, the coupling bridge 350 may be positioned at a single position of the lower end of the front panel 300. Alternatively, the coupling bridge 350 may be positioned at a plurality of positions on the lower end of the front panel 300. Although the coupling bridge 350 will be described hereinafter as being provided at the single position of the lower end of the front panel 300, the embodiment of the coupling bridge 350 is not limited thereto.

The cable harness 360 serves to electrically connect electronic elements provided at the display unit 310 and/or the front panel 300 to electronic elements arranged in the main body 100. The cable harness 360 may include a plurality of electric wires.

The coupling bridge 350 is configured to accommodate the cable harness 360 used to electrically connect the front panel 300 and the main body 100 to each other. The coupling bridge 350 may take the form of a hollow column to accommodate and surround the cable harness 360.

After the coupling bridge 350 is inserted into the opening 101 of the main body 100, the coupling bridge 350 is secured to an inner peripheral position of the opening 101, thereby being secured to the main body 100. Once the coupling bridge 350 is secured to the main body 100, the front panel 300 hinged to the coupling bridge 350 may be pivoted and opened away from the main body 100.

The coupling bridge 350 serves to guide the cable harness 360 into the main body 100. The cable harness 360 accommodated in the coupling bridge 350 is guided into the main body 100 along the coupling bridge 350 once the coupling bridge 350 is coupled to the main body 100, thereby being connected to the electronic elements arranged in the main body 100.

As the coupling bridge 350 serves not only to hingedly couple the main body 100 and the front panel 300 to each other, but also to accommodate and guide the cable harness 360 into the main body 100, the coupling bridge 350 realizes both a guidance structure for the cable harness 360 and a hinge coupling structure between the front panel 300 and the main body 100, which may reduce the number of assembly operations and assure easy assembly.

A harness cover 330 may be provided at one side of the front panel 300 to shield the cable harness 360, so as to prevent the cable harness 360 from being exposed to the outside. The front panel 300 may be provided with an opening (not shown) through which the cable harness 360 is exposed to the outside to allow a user to access the cable harness 360 so as to guide the cable harness 360 into the coupling bridge 350. Accordingly, the user can easily access and operate the cable harness 360 through the opening so as to guide the cable harness 360 into the coupling bridge 350.

The harness cover 330 serves to shield the cable harness 360 so as to prevent the cable harness 360 from being exposed to the outside. As a result of shielding the cable harness exposure opening of the front panel 300 using the harness cover 330, the front panel 300 exhibits aesthetically pleasant external appearance in an open state thereof. In addition, the harness cover 330 serves to protect the cable harness 360 from damage.

The harness cover 330 is arranged adjacent to the coupling bridge 350. The cable harness 360 to be accommodated in the coupling bridge 350 extends from an interior position of the front panel 300 or the display unit 310 to an interior position of the main body 100 by way of the coupling bridge 350 and is connected to the main body 100. In this case, the cable harness 360 passes through the harness cover 330 prior to entering the coupling bridge 350. Since the harness cover 330 is arranged adjacent to the coupling bridge 350, the harness cover 330 can be guided to the coupling bridge 350 immediately after passing through the harness cover 330.

A harness cover connection hole 340 is perforated in a distal end of the harness cover 330, for penetration of the cable harness 360. The cable harness 360 having passed through the harness cover connection hole 340 is directly guided into the coupling bridge 350. That is to say, the cable harness 360 sequentially passes through the harness cover connection hole 340 and the opening 101 of the main body 100 and then, is connected to the main body 100.

As the cable harness 360 is covered by the harness cover 330 and simultaneously, is connected to the main body 100 by sequentially passing through the end of the harness cover 330 and the opening 101 of the main body 100, it is possible to minimize an exposure area of the cable harness 360, which provides the front panel 300 with aesthetically pleasant external appearance and effectively protects the cable harness 360 from external shock.

A cable harness guide 370 extends from one side of the front panel 300 at a position adjacent to the coupling bridge 350 and serves to guide the cable harness 360. The cable harness guide 370 may be formed at the lower end of the front panel 300 and may extend from the front panel 300 toward the coupling bridge 350 so as to be arranged adjacent to the coupling bridge 350. The cable harness guide 370 accommodates the cable harness 360 therein and guides the cable harness 360 to the coupling bridge 350.

The coupling bridge 350 is hinged to one side of the cable harness guide 370. The cable harness guide 370 extends downward from the lower end of the front panel 300 and is foldably hinged at a lower end thereof to the coupling bridge 350. As such, the cable harness 360 is coupled to the main body 100 while being accommodated in the cable harness guide 370 and the coupling bridge 350.

Figure 12:
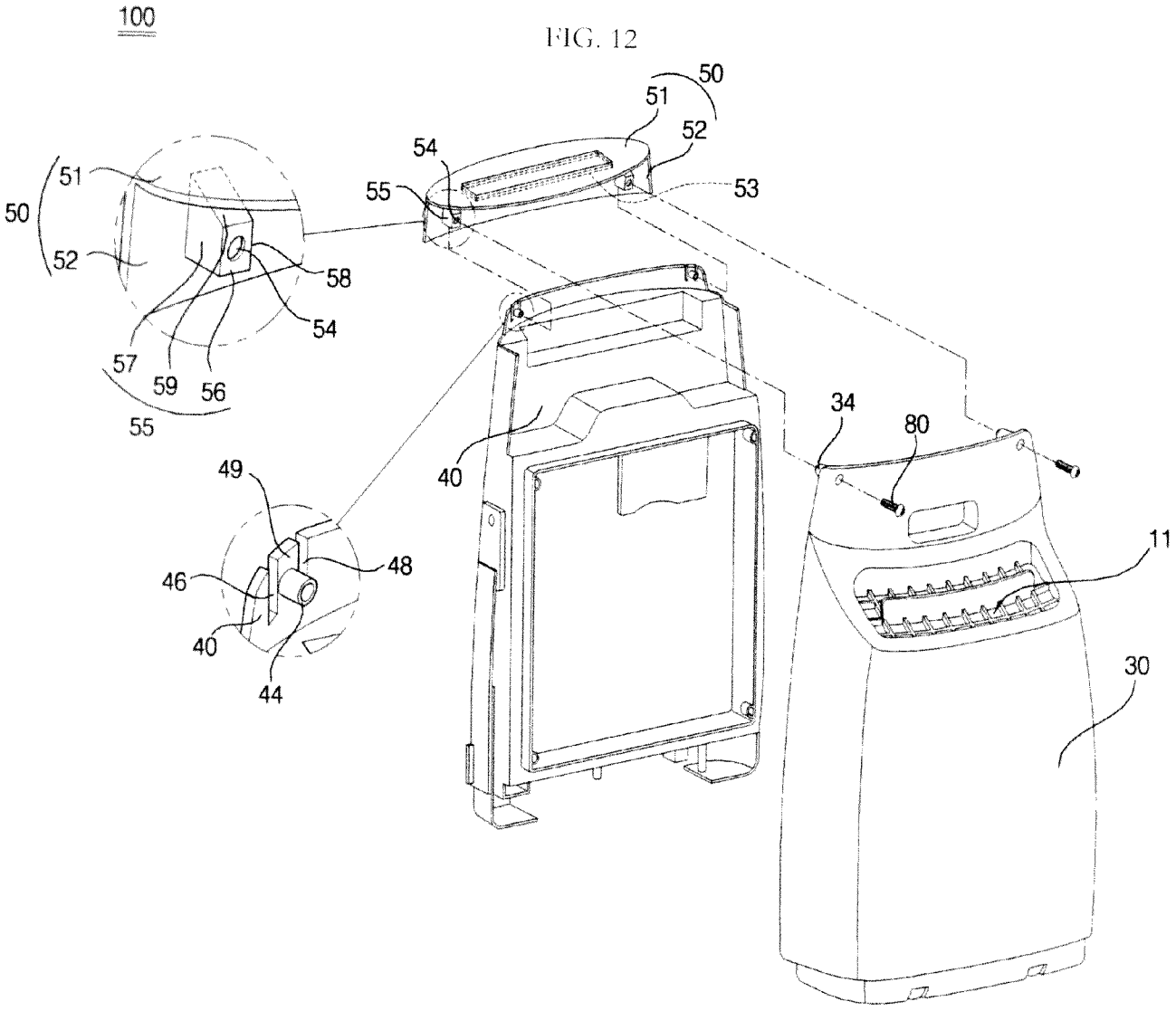
FIG. 12 is an exploded perspective view of a main body illustrated in FIG. 3.
Figure 13:
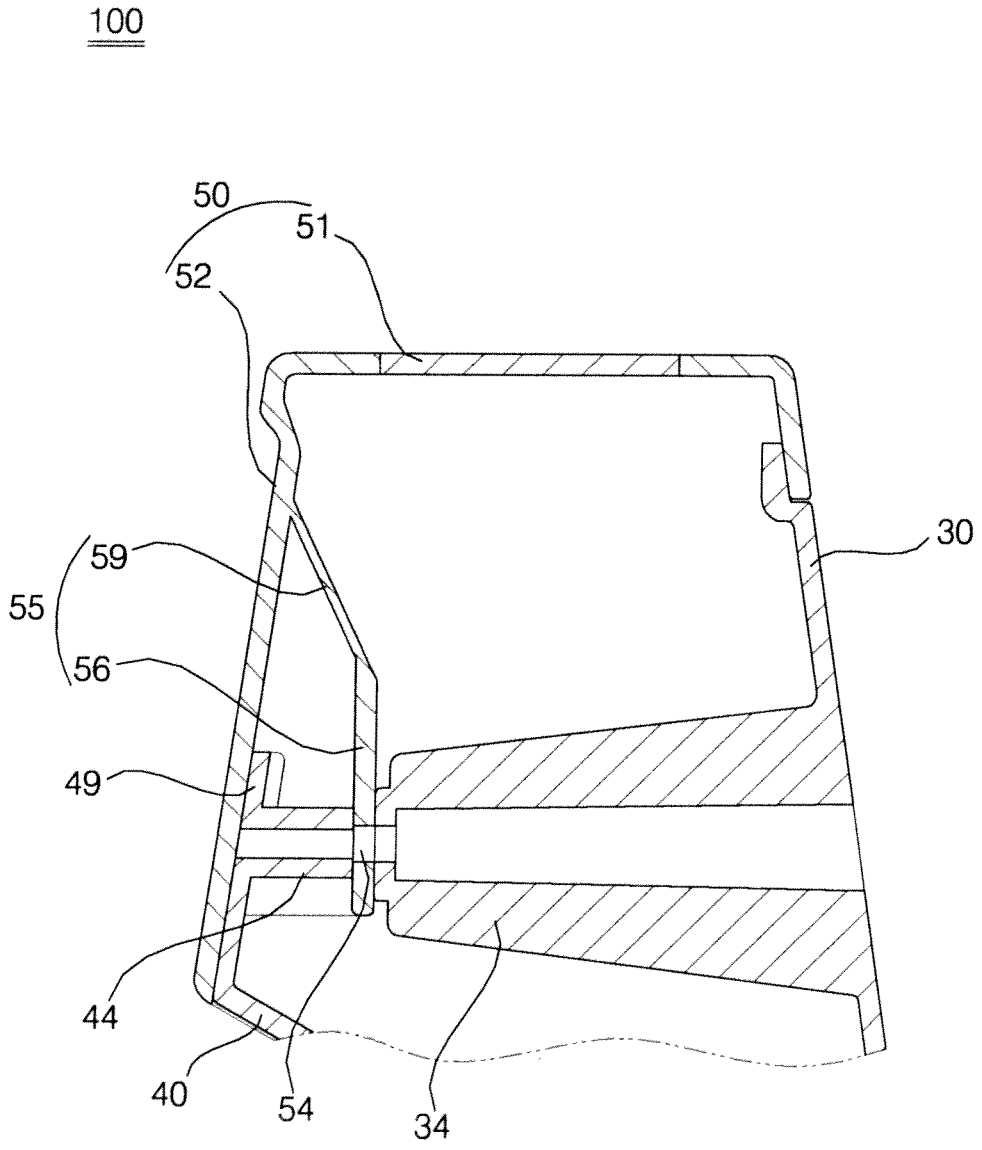
FIG. 13 is a sectional view illustrating an assembled state of a rear case, a front case and an upper decoration illustrated in FIG. 12.

FIG. 12 is an exploded perspective view of the main body 100 illustrated in FIG. 3, and FIG. 13 is a sectional view illustrating an assembled state of a rear case, a front case and an upper deck illustrated in FIG. 12.

Referring to FIGS. 12 and 13, the main body 100 in accordance with an embodiment of the present invention includes a rear case 30, a front case 40 located in front of the rear case 30, and an upper deck 50 provided at the top of the front case 40.

The rear case 30 defines the external appearance of the rear surface of the air conditioner. The rear case 30 may be provided with the above described air discharge port 11.

The front case 40 constitutes the main body 100 along with the rear case 30. The tray entrance/exit aperture 111 may be perforated in at least one of left and right surfaces of the front case 40, through which the humidifying gear assembly 200 enters or exists.

The upper deck 50 defines the external appearance of the upper surface of the air conditioner and includes a horizontal upper plate 51 and a front plate 52 extending downward from a front end of the upper plate 51.

In an embodiment, the upper deck 50 may be an ornamental member or a cover member to improve the external appearance of the air conditioner and protect the upper part of the front case 40. The upper deck 50 may include a control panel on which at least one of an operating unit to allow the user to operate the air conditioner and the display unit to display operational information of the air conditioner are installed.

If the upper plate 51 of the upper deck 50 functions as the control panel, a circuit board (53 in FIG. 12) may be attached to a lower surface of the upper plate 51. The circuit board 53 may be provided with a button or rotary switch to constitute the operating unit and a Light Emitting Diode (LED) or Liquid Crystal Display (LCD) to constitute the display unit.

The front plate 52 of the upper deck 50 may have a height determined to hide the front of the circuit board and thus, may serves as a circuit board cover. The front plate 52 may be arranged in front of an upper portion of the front case 40 and may function as a front case cover. The front plate 52 is provided with couplers to be coupled to the rear case 30 and the front case 40. That is, the front plate 52 may serve as an upper deck mount.

The rear case 30, the front case 40 and the upper deck 50 may be fastened to one another by means of a fastening member 80 and may be respectively provided with a fastening portion for the fastening member 80. Hereinafter, a fastening structure of the rear case 30, the front case 40 and the upper deck 50 will be described in detail.

In one embodiment, the fastening member 80 may sequentially penetrate, starting from the rear side of the rear case 30, a rear fastening portion 34 formed at the rear case 30 and a deck fastening portion 55 formed at the upper deck 50 and thereafter, be fastened into a front fastening portion 44 formed at the front case 40. Alternatively, the fastening member 80 may sequentially penetrate, starting from the rear side of the rear case 30, the rear fastening portion 34 formed at the rear case 30 and the front fastening portion 44 formed at the front case 40 and thereafter, be fastened into the deck fastening portion 55 of the upper deck 50.

In another embodiment, the fastening member 80 may sequentially penetrate, starting from the front side of the front case 40, the deck fastening portion 55 formed at the upper deck 50 and the front fastening portion 44 formed at the front case 40 and thereafter, be fastened into the rear fastening portion 34 formed at the rear case 30. Alternatively, the fastening member 80 may sequentially penetrate, starting from the front side of the front case 40, the fastening portion 44 formed at the front case 40 and the deck fastening portion 55 formed at the upper deck 50 and thereafter, be fastened into the rear fastening portion 34 formed at the rear case 30.

Since it is desirable in terms of aesthetically pleasant external appearance that the fastening member 80 be invisible from the front side of the air conditioner, the fastening member 80 preferably begins to be fastened starting from the rear side of the rear case 30.

The main body 100 will be described hereinafter as the deck fastening portion 55 of the upper deck 50 being formed at the front plate 52 of the upper deck 50 and as the fastening member 80 sequentially penetrating, starting from the rear side of the rear case 30, the rear fastening portion 34 formed at the rear case 30 and the deck fastening portion 55 formed at the upper deck 55 and thereafter, be fastened into the front fastening portion 44 formed at the front case 40.

In an embodiment, the fastening member 80 may be a threaded screw, the rear fastening portion 34 formed at the rear case 30 may be a rear boss through which the fastening member 80 in the form of the threaded screw is fastened, and the front fastening portion 44 formed at the front case 40 may be a front boss through which the fastening member 80 in the form of the threaded screw is fastened.

More specifically, the rear case 30 may be provided at an upper end thereof with the rear fastening portion 34 for penetration of the fastening member 80, and the front case 30 may be provided at a position facing the rear fastening portion 34 with the front fastening portion 44 for penetration of the fastening member 80. Also, the deck fastening portion 55 of the upper deck 50 may be provided with a through-hole 54 for penetration of the fastening member 80 and be configured to allow the front fastening portion 44 to be inserted thereinto. In this way, the fastening member 80 may sequentially penetrate the rear fastening portion 34 and the through-hole 54 and thereafter, be fastened into the front fastening portion 44.

The rear fastening portion 34 may forwardly protrude from the rear case 30, the front fastening portion 44 may rearwardly protrude from the front case 40, and the deck fastening portion 55 may rearwardly protrude from a rear surface of the front plate 52 of the upper deck 50.

The deck fastening portion 55 may take the form of a box, the bottom of which is open for insertion of the front fastening portion 44.

The box-shaped deck fastening portion 55 may be constructed by a rear wall plate 56 in which the through-hole 54 is perforated, the rear wall plate 56 being spaced apart from the rear surface of the front plate 52, a left wall plate 57 to connect the rear surface of the front plate 52 and a left end of the rear wall plate 56 to each other, and a right wall plate 58 to connect the rear surface of the front plate 52 and a rear end of the rear wall plate 56 to each other.

The deck fastening portion 55 may further include an upper wall plate 59 to connect the rear surface of the front plate 52 and an upper end of the rear plate 56 to each other.

The front fastening portion 44 may protrude rearward from a piece protruding upward from the upper end of the front case 40, or may protrude rearward from a rear surface of the front case 40. Preferably, the front fastening portion 44 may protrude rearward from the front case 40 in terms of strength, etc.

The front case 40 may be provided at the left side of the front fastening portion 44 with a left avoidance recess 46 to avoid the left wall plate 57 and at the right side of the front fastening portion 44 with a right avoidance recess 48 to avoid the right wall plate 58.

Preferably, heights of the left avoidance recess 46 and the right avoidance recess 48 are determined in such a manner that they are hidden by the front plate 52 when the front fastening portion 44 is inserted into the deck fastening portion 55.

Also, preferably, the heights of the left avoidance recess 46 and the right avoidance recess 48 are determined in such a manner that a hole of the front fastening portion 44 and the through-hole 54 of the deck fastening portion 55 coincide with each other in a front-and-rear direction when the left and right wall plates 57 and 58 of the deck coupling portion 55 are respectively inserted into the left and right avoidance recesses 46 and 48 until lower ends of the left and right wall plates 57 and 58 are caught by lower ends of the left and right avoidance recesses 46 and 48.

The left avoidance recess 46 and the right avoidance recess 48 are preferably configured to enable snap-fitting of the left wall plate 57 and the right wall plate 58 when the upper deck 50 and the front case 40 are fastened to each other.

In the air conditioner having the above described configuration, to manually assemble the rear case 30, the front case 40 and the upper decoration 50 with one another, the front fastening portion 44, i.e. an intermediate portion 49 between the left avoidance recess 46 and the right avoidance recess 48 of the front case 40 is are inserted into the deck fastening portion 55 of the upper deck 50 in a state in which the upper deck 50 is located on the front case 40.

During the above described insertion, the left wall plate 57 of the deck fastening portion 55 is inserted into the left avoidance recess 46 of the front case 40 and the right wall plate 58 of the deck fastening portion 55 is inserted into the right avoidance recess 48 of the front case 40.

The through-hole 54 of the deck fastening portion 55 and the hole of the front fastening portion 44 may coincide with each other in a front-and-rear direction. Thereby, the upper deck 50 and the front case 40 are tentatively assembled to each other as the deck fastening portion 55 is inserted into the front fastening portion 44.

Thereafter, the assembly of the front case 40 and the upper deck 50 may be manually positioned in front of the rear case 30, and the fastening member 80 may be inserted into a hole of the rear fastening portion 34 from the rear side of the rear case 30. Upon insertion of the fastening member 80, the fastening member 80 sequentially passes through the hole of the rear fastening portion 34 and the through-hole 54 of the decoration fastening portion 55 and the, is fastened into the hole of the front fastening portion 44.

In a state in which the upper deck 50 is fastened as described above such that the deck fastening portion 55 is located between the rear fastening portion 34 and the front fastening portion 44, the upper deck 50, the rear case 30 and the front case 40 are assembled to one another by means of the fastening member 80, which assures simplified strong assembly of the rear case 30, the front case 40 and the upper deck 50.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

a tray in which humidifying water is stored by a predetermined height, the tray being detachably attached to a main body;

a humidifying gear rotatably arranged in the tray, the humidifying gear being detachably attached to the tray;

a lifter provided at a periphery of the humidifying gear, the lifter being submerged under the humidifying water so as to scoop up the humidifying water during rotation of the humidifying gear; and a humidifying filter provided in the humidifying gear and spaced apart from the humidifying water such that the humidifying water is supplied from the lifter to the humidifying filter during rotation of the humidifying gear, wherein a diameter of the humidifying filter is less than a diameter of the humidifying gear, wherein the humidifying gear includes:

a humidifying gear body provided at a periphery thereof with the lifter, the humidifying gear body accommodating the humidifying filter therein; and a humidifying gear cover separably coupled to the humidifying gear body so as to fix the humidifying filter accommodated in the humidifying gear body, wherein a coupling recess is formed in any one of a central portion of the humidifying gear body and a central portion of the humidifying gear cover and a coupling protrusion is formed at the other central portion so as to be separably inserted into the coupling recess, wherein a periphery of the humidifying gear body and a periphery of the humidifying gear cover are separably coupled to each other, wherein:

a sliding insertion groove is formed in any one of the periphery of the humidifying gear body and the periphery of the humidifying gear cover and a sliding insert is formed at the other periphery so as to be inserted into the sliding insertion groove; and the sliding insert is inserted into the sliding insertion groove when the coupling protrusion is inserted into the coupling recess.

2. The air conditioner according to claim 1, wherein the humidifying filter is provided in the humidifying gear.

3. The air conditioner according to claim 1, wherein the humidifying gear is separably provided to enable separation of the humidifying filter.

4. The air conditioner according to claim 1 wherein the coupling protrusion is rotated after being inserted into the coupling recess, thereby being fixed to a fixing recess formed at one end of the coupling recess.

5. The air conditioner according to claim 1, wherein:

the coupling protrusion is rotated after being inserted into the coupling recess, thereby being fixed to a fixing recess formed at one end of the coupling recess; and the sliding insert slides in the sliding insertion groove when the coupling protrusion is fixed to the fixing recess, thereby being coupled into a sliding coupling groove formed at one end of the sliding insertion groove.

6. The air conditioner according to claim 1, wherein a plurality of openings are formed at the humidifying gear body to enable air circulation.

7. The air conditioner according to claim 1, wherein a plurality of openings are formed at the humidifying gear cover to enable air circulation.

8. The air conditioner according to claim 1, wherein a height from a bottom surface of the tray to the humidifying filter is greater than the highest water storage height of the humidifying water.

9. The air conditioner according to claim 1, further comprising a rotator rotatably provided in a region of the main body.

10. The air conditioner according to claim 9, wherein the lifter is connected to the rotator when the tray is attached to the main body and serves to scoop up the humidifying water upon receiving rotational force of the rotator during rotation of the rotator.

11. The air conditioner according to claim 1, wherein the lifter is provided with a recessed portion to scoop up the humidifying water.

12. The air conditioner according to claim 1, further comprising a blower fan provided in the main body to circulate air, wherein the humidifying filter humidifies air passing through the humidifying filter by operation of the blower fan during rotation of the humidifying gear.

* * * * *